United States Patent [19]

Wallschlaeger

[11] Patent Number: 4,995,408

[45] Date of Patent: Feb. 26, 1991

[54] COSMETIC SAMPLE APPLICATOR AND METHOD OF CONSTRUCTION

[75] Inventor: Gunnar J. Wallschlaeger, Fort Lauderdale, Fla.

[73] Assignee: Lip-Prints, Inc., Pompono Beach, Fla.

[21] Appl. No.: 351,708

[22] Filed: May 15, 1989

[51] Int. Cl.[5] ..... A45D 40/26

[52] U.S. Cl. ..... 132/320; 206/823

[58] Field of Search ..... 132/286, 293, 312, 317, 132/320, 333, 294, 314; 206/581, 823

[56] References Cited

U.S. PATENT DOCUMENTS

| | | | |
|---|---|---|---|
| 1,632,864 | 6/1927 | Weber | 132/294 |
| 2,597,130 | 5/1952 | Ross | 132/314 |
| 3,851,655 | 12/1974 | Tarro | 132/294 |
| 3,860,016 | 1/1975 | Mackiernan | 132/317 |
| 4,337,859 | 7/1982 | Murphy et al. | 132/294 |
| 4,471,874 | 9/1984 | Morane | 206/581 |
| 4,611,611 | 9/1986 | Beal, Jr. | 132/320 |
| 4,805,773 | 3/1989 | Sabongi | 206/823 |
| 4,824,143 | 4/1989 | Grainger | 132/317 |

*Primary Examiner*—John J. Wilson
*Assistant Examiner*—Frank A. LaViola

[57] ABSTRACT

A cosmetic sampler comprising a base support, a coating of a cosmetic composition of predetermined thickness disposed upon the base support, a cover and a multiplicity of projections extending through the coating in a direction substantially transverse to the plane of the base support and cover and having a length greater than the thickness of the coating. The coating composition is transferable to a user upon lifting up of the cover in order to remove it.

15 Claims, 2 Drawing Sheets

COSMETIC SAMPLE APPLICATOR AND METHOD OF CONSTRUCTION

FIELD OF THE INVENTION

This invention relates to the field of sample applicators for cosmetics, particularly lipsticks, facial make-up, such as base creme, eye shadow and chapstick, etc. More particularly, this invention relates to a cosmetic sample applicator and method of construction of an applicator so that it is readily transportable and easily handled without affecting the integrity of the cosmetic composition in the applicator.

BACKGROUND OF THE INVENTION

Sampling of cosmetics is essential to the successful marketing of cosmetic products. Over-the-counter point-of-sale sampling is a powerful marketing tool for product promotion. In fact, where possible, samples of products are given away free to a potential customer or the customer is invited to try a product out without cost. For some cosmetic products, such as lipstick, women do not seem able to judge its desirability without applying it directly to their lips and, accordingly, need to sample the product before buying it. However, the majority of women today are aware of the possible contamination and health risks associated with multiple sampling from a common sample, and therefore, Will only use an unused whole tube of lipstick when applying a sample. Multi-use of a cosmetic, such as lipstick, from a single container or tube is unsanitary, invites consumer complaints, and potentially invites lawsuits. The use of a lipstick tube for common sampling by more than one person is now considered socially and medically unacceptable.

To overcome the sampling problem due to the health hazards attributable to multi-use of a cosmetic from a single container, the cosmetic industry has manufactured miniaturized versions of their lipstick products, known as "mini-tube cosmetic lipstick samplers." Such products are still subject to contamination and multi-use application. More importantly, the cost of the mini-tube and the material cost of packaging still amounts to a substantial loss per unit for the manufacturer. Various other sampling methods, such as "open sampling" in which a sample is taken from an open pot by means of a cotton swab or by the use of a finger is also considered to be unsanitary. Test strips and sample sticks have also been commercially tried and found to be messy, inconvenient and not very effective.

U.S. Pat. No. 4,611,611 discloses a lipstick applicator and method of making same wherein the applicator is constructed of a piece of paper folded over on itself to form two flaps, wherein an upper and lower lip-print of lip cosmetic is deposited on the facing surfaces of the flaps for applying the lipstick by reverse-folding the flaps, inserting them into the mouth, fold first, and compressing the lips against them while pulling the applicator out. By instinct, everyone knows where the edges of their lips are, so that in the process of blotting their lips, the lipstick can be applied to the lip edges for a clean and distinct print. It has been demonstrated, however, that the cosmetic in the applicator tends to smear under relatively normal handling conditions, such as in packaging, during transit, and upon prolonged storage in various environments of heat and humidity, etc.

A method has been discovered, in accordance with the present invention, to fabricate a cosmetic sample applicator which can withstand relatively rough handling in packaging and transportation, and which will maintain the integrity of the cosmetic composition up to the moment of application.

SUMMARY OF THE INVENTION

The cosmetic sampling applicator of the present invention comprises: a base support; a coating of a cosmetic composition of predetermined thickness disposed upon said base support; a cover for covering said coating and a multiplicity of projections extending through said coating in a direction substantially transverse to the plane of said base support and said cover, respectively, with the projections having a length greater than the thickness of said coating, such that said cover is spaced apart from said coating when in its covered position.

The invention also includes a method of constructing a cosmetic sampler comprising the steps of: depositing a layer of a cosmetic composition having a paste-like or creamy consistency upon a surface of a base support to form a cosmetic coating of predetermined thickness, covering said cosmetic coating with a removable cover; and forming a multiplicity of projections between said base support and cover with said projections extending through said cosmetic coating in a direction substantially transverse to the plane of said base support and cover, respectively, and having a length greater than the thickness of said cosmetic coating so as to maintain a space between said cover and said cosmetic coating while said coating is covered.

In accordance with this invention, a transferrable coating, such as lipstick, may be printed on a transfer paper and the integrity of the print preserved during handling and storage operations prior to actual use, especially where the handling may include stacking, moving, and bending, and the products may be exposed to changes in temperature and humidity, as well as other normal handling operations from the point of manufacture to the ultimate point of sale to the consumer. The invention is based upon the surprising finding that the incorporation of a multiplicity of projections between the cover sheets which extend through the cosmetic layer in an upright direction with their length greater than the coating thickness acts to preserve the integrity of the cosmetic coating during handling and yet readily permits the coating to be transferred to the lips or facial skin of the user without smearing or smudging. In one embodiment of the invention, a transferrable coating of a cosmetic, e.g., lipstick in the form of a lip print, is placed between cover sheets that contain the aforesaid projections.

Another embodiment of the invention involves placing the transferrable lipstick coating directly on opposite surfaces containing the projections and placing a gum-like wrapper as a cover sheet over the coated surfaces. The lipstick coating is generally deposited in thicknesses of less than 10 mils and more desirably in thicknesses of less than 6 mils. Accordingly, the projections should be designed to extend only slightly above the thickness of the transferrable coating, to protect the coating and yet allow a full, even coat of lipstick or other cosmetic coating to be transferred to one's lips.

BRIEF DESCRIPTION OF THE DRAWINGS

FIG. 5b shows the preferred cover for the applicator of FIG. 5a.

DESCRIPTION OF THE PREFERRED EMBODIMENT

Figure 1:
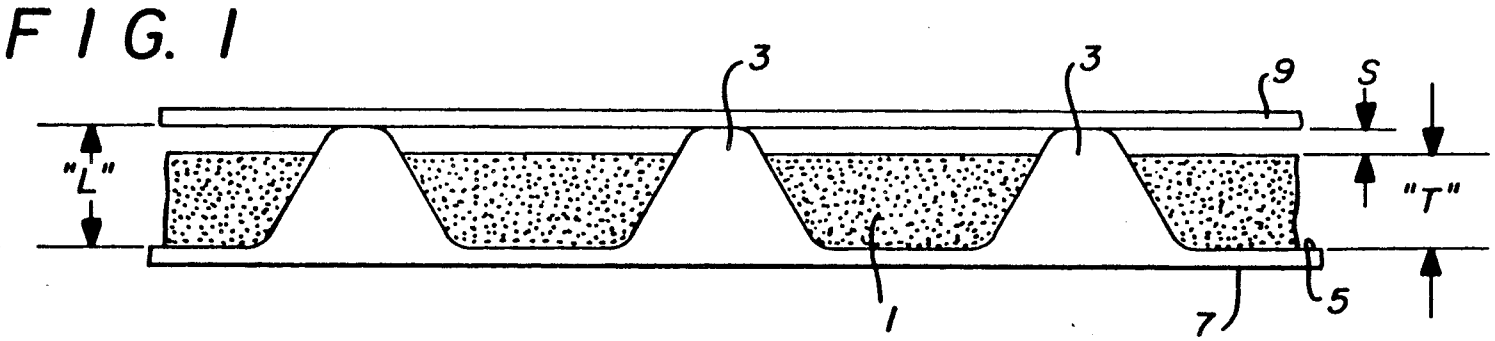
FIG. 1 is a diagrammatic view in cross-section of the cosmetic sample applicator of the present invention.
Figure 2:
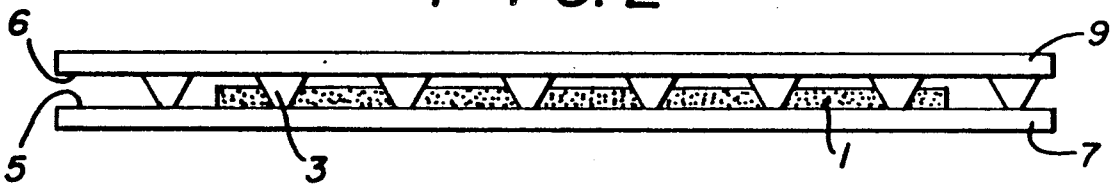
FIG. 2 is a view similar to FIG. 1 showing an alternative arrangement for the projections of FIG. 1.

Referring to FIGS. 1 and 2, a thin layer of a transferrable cosmetic coating, such as lipstick (1) or other cosmetic, may have its integrity preserved during handling and storage operations prior to transfer by interposing a series of projections (3) through the cosmetic coating in a direction transverse to the opposed smooth surfaces (5) and (6) of cover sheets (7) and (9). The layer of lipstick (1) may be deposited in any convenient thickness, preferably ranging from about 1 to about 10 mils (thousandths of an inch), and more preferably between about 2 and about 6 mils. The deposition of the cosmetic may be made by any conventional printing method, such as flexographic and silk-screening. In addition, the lipstick may be placed on the base material in an irregular manner with a layer of material laminated over the lipstick which is die cut in the desired lip shape. The composition of the cosmetic is not critical to the present invention, nor is its physical characteristics. Accordingly, the cosmetic composition can be a wax of paste-like consistency or a gel or cream composition.

The cosmetic coating (1) may be deposited over the smooth surface (5) containing the projections (3), as shown in FIG. 1, or alternatively, the projections (3) may extend from the surface (6) of cover (9) opposite the surface (5) upon which the cosmetic (1) is deposited, as shown in FIG. 2. Both configurations produce the desired result of preserving the integrity of the cosmetic layer (1).

For a lipstick cosmetic, the cover sheets (7) and (9) are preferably flat planar sheets of material which form flat surfaces arranged in parallel planes relative to one another. For another cosmetic, such as eye shadow, the covers (7) and (9) may be arranged as concentric cylinders. The composition of the cover materials (7) and (9) may be selected from a wide variety of materials, such as paper, plastic or composites. The covers (7) and (9) may also be laminated in layers, or coated. A plastic-coated sheet of paper may be used, for example, to prevent leaching of oils or other components from the cosmetic composition into the cover material to prevent degradation of the cosmetic. Generally speaking, wax or plastic, coated or impregnated into sheets of paper, may be usable for this purpose.

The incorporation of a multiplicity of projections (3) into the applicator is critical to the practice of the present invention. The projections (3) function as support columns between the top cover (9) and the base support or bottom cover (7) to protect the cosmetic coating (1) from damage. Accordingly, it is essential that the length of the projections ("L") be greater than the thickness ("T") of the cosmetic coating, such that a space ("S") is formed between the surface of the cosmetic coating (1) and the top cover (9). This prevents crushing of the cosmetic from external pressure and prevents the cosmetic from squeezing out from the ends or lateral sides between the cover sheets (7) and (9), respectively. The optimum distance ("S") will vary based on the strength of the projections (3), the composition of the cover sheets (7) and (9), the number of projections (3), and their distribution on the cover sheet(s). It is, however, necessary for the projections (3) to extend through the cosmetic composition to provide the desired support function. Surprisingly, this does not affect the integrity of the cosmetic composition and does not cause any problem in depositing the cosmetic composition over the projections, or in transferring the cosmetic from the base support cover to the user.

The projections (3) should generally point upright in a direction transverse to the plane of the cover sheets (7) and (9), respectively. The projections (3) may take any shape or geometry. Accordingly, the projections (3) may be conical, pyramidal, truncated pyramidal, frusto-conical or cylindrical. In general, the projections (3) should have a wider dimension than their length to provide strength and the top of the projections (3) should be blunt ended or rounded. This, however, is dependent upon the composition of the projections. The projections can be of any composition, including paper, wax or plastic, which will not interact with the coating composition. A paper or wax composition compatible with the composition of the cover material is preferred. If the projections are formed from plastic, they may be needle-like in geometry and still provide sufficient strength. The projections should, however, be sufficiently resilient to permit a cosmetic coating to be deposited thereover by any conventional printing method.

The projections (3) may form various patterns or styles, as shown in FIGS. 3a–3h for illustration, including dots, oval, diamond, honeycomb, and pyramid row. The pattern or style is not critical to the present invention. However, a symmetrical pattern is preferred to an asymmetrical pattern. The number of projections are relevant to the issue of strength. In general, the projections should occupy a minimum of about three percent of the surface area of the sheet to be coated with cosmetic, with a minimum of five percent being preferred. If the projections occupy too much of the surface area of the cover sheet upon which the coating is deposited, the coating becomes too spotty and will not be visibly attractive to the user.

The projections (3) may be formed integrally with the deposition of the cosmetic layer or may be formed as a separate operation prior to or during assembly of the applicator. Thus, the projections (3) may be printed, molded, thermoformed, thermographed, silk-screened, laminated, embossed, reverse embossed, vacuum-formed, or even printed with puff ink that expanded upon heating. Embossing is currently the preferred method for forming projections on one of the covers.

Figure 4:
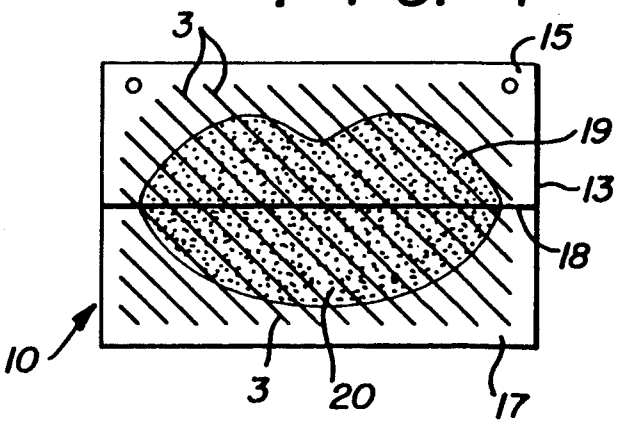
FIG. 4 shows one type of a folded open lipstick sample applicator, embodying the principles of FIGS. 1 and 2.

A sample applicator using the principles of the invention is illustrated in FIG. 4. This is basically the same applicator as described in U.S. Pat. No. 4,611,611, the disclosure of which is herein incorporated by reference with the projections (3) incorporated into the applicator. The lipstick applicator (10) is shown folded open, consisting of a bisected sheet (13) forming two halves (15) and (17) and a fold (18). An upper human lip print (19) is formed on one half (15) of sheet (13), and a lower human lip print (20) is formed on the other half (17). The lip prints are applied by any conventional printing technique which leaves a layer or coating of the desired cosmetic composition. The lip prints (19) and (20) are centered along the fold (18). The multiplicity of raised projections (3) are formed on both of the halves (15) and (17) by cross-intersecting while in the folded position, which protects the integrity of the lip prints (19) and (20). Each of the halves are folded so that each half faces each other. The raised projections separate the two halves to provide a space or clearance between the lip prints. The applicator is put into use by reverse folding the two halves.

Figure 5B:
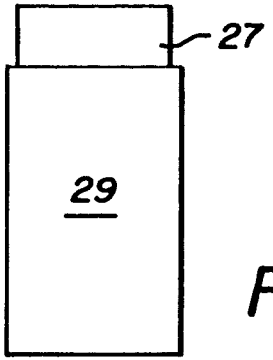
Figure 5A:
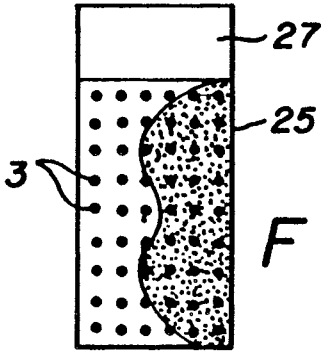
FIG. 5a shows another type of applicator, embodying the principles of the present invention.
Figure 3A:
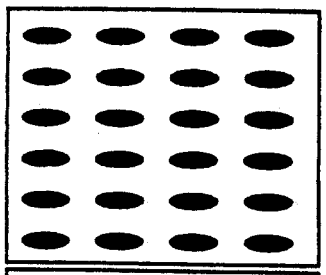
FIGS. 3a–3h show a variety of different geometric patterns for the projections of FIGS. 1 and 2.
Figure 3B:
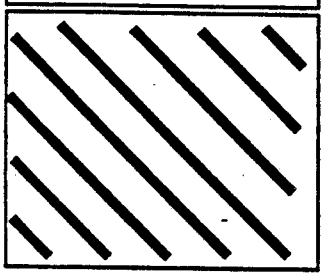
Figure 3C:
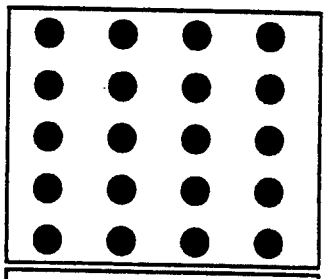
Figure 3D:
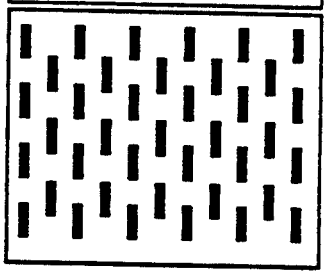
Figure 3E:
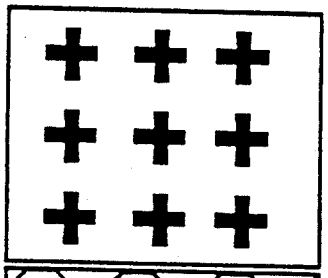
Figure 3F:
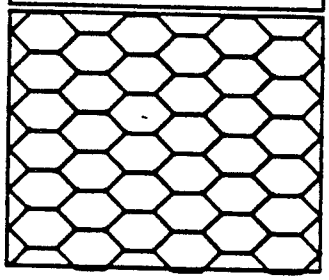
Figure 3G:
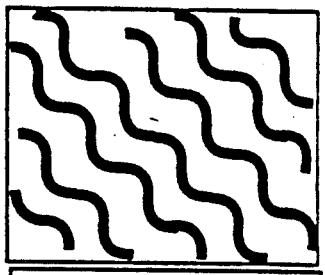
Figure 3H:
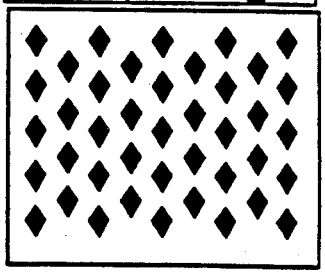

An alternative embodiment is shown in FIGS. 5*a* and 5*b*. The lipstick layer (25) is deposited on each side of a strip (27) of paper or plastic having a multiplicity of raised projections (3). A cover (29), in the form of a gum wrapper is used to cover both sides of the strip simultaneously. The raised projections (3) separate each lipstick layer (25) from the cover (29).

The preferred method of forming an applicator in accordance with the present invention involves starting with an endless strip of material upon which the raised projections (3) are stamped or embossed in sequence over selected sections of the strip as the strip is advanced. In succession or as an integral operation, a coating of cosmetic composition is silk-screened or otherwise deposited over selected sections. The strip is then advanced through a heating unit to heat treat the cosmetic layers. The heat treatment is carried out at a temperature around 140° F. to melt the amorphous surface of the cosmetic coating to form a hardened surface through which the raised projections (3) extend. The strip may be die cut and successively folded to form individual cosmetic sampling applicators.

I claim:

1. A cosmetic sampler comprising: a base support; a coating of cosmetic composition having a predetermined thickness disposed upon said base support; a detachable cover for covering said coating and a multiplicity of finger-like projections extending and penetrating through said coating in a direction substantially transverse to said base support and said cover, respectively, with the projections distributed throughout said coating and having a length greater than the thickness of said coating, such that said cover is spaced apart from said coating by said projections.

2. A cosmetic sampler, as defined in claim 1, wherein said projections have a geometry which, in cross-section, provide a width adjacent the cover which is equal to or less than the width of the projection adjacent said base.

3. A cosmetic sampler, as defined in claim 2, wherein said projections have a width greater than its length.

4. A cosmetic sampler, as defined in claim 2, wherein said projections are substantially symmetrical in distribution throughout said coating.

5. A cosmetic sampler, as defined in claim 4, wherein said coating covers a predetermined surface area of said base support with said projections occupying a minimum of about five percent of the surface area occupied by said coating.

6. A cosmetic sampler, as defined in claim 4, wherein said base support and said cover are flat planar, sheet-like surfaces.

7. A cosmetic sampler, as defined in claim 6, wherein said base support and cover are composed of a material selected from the group consisting of paper, wax and plastic.

8. A cosmetic sampler, as defined in claim 7, wherein said base support and cover are connected together along a common fold line to form two foldable half sheets.

9. A cosmetic sampler, as defined in claim 4, wherein said base support is of rectangular geometry, with said cosmetic coating disposed on opposite sides thereof.

10. A cosmetic sampler, as defined in claim 9, wherein said projections extend from said base support.

11. A cosmetic sampler, as defined in claim 2, wherein said projections are distributed in a styled pattern of preselected geometry.

12. A method of constructing a cosmetic sampler comprising the steps of: depositing a layer of a cosmetic composition having a paste-like or creamy consistency upon a surface of a base support to form a cosmetic coating of predetermined thickness, covering said cosmetic coating with a removable cover; and forming a multiplicity of finger-like projections between said base support and removable cover with said projections extending and penetrating through said cosmetic coating in a direction substantially transverse to said base support and cover, respectively, and with said projections being distributed throughout said coating and having a length greater than the thickness of said cosmetic coating so as to maintain said removable cover spaced apart from said cosmetic coating when said removable cover is covering said cosmetic.

13. A method, as defined in claim 12, wherein said projections are formed by a deposition process selected from the group consisting of: printing, molding, thermoforming, silk-screening, embossing, reverse embossing, thermography, laminating, vacuum forming, and by application of puff ink.

14. A method, as defined in claim 13, wherein said sampler is formed in a continuous process from an endless strip, with said coating of cosmetic deposited upon selected sections of said strip forming the base support, and with said projections also formed upon selected sections in an operation integral with said process.

15. A method, as defined in claim 14, further comprising the step of heat treating the coating of cosmetic upon said base support to cause the surface of the cosmetic coating, exposed to the cover and through which the projections extend, to harden.

* * * * *